US012196206B2

(12) United States Patent
Kim et al.

(10) Patent No.: US 12,196,206 B2
(45) Date of Patent: Jan. 14, 2025

(54) OUTER RING FOR AN OIL PUMP AND A METHOD FOR MANUFACTURING THE SAME

(71) Applicants: HYUNDAI MOTOR COMPANY, Seoul (KR); KIA CORPORATION, Seoul (KR); MYUNG HWA IND. CO., LTD., Ansan-si (KR)

(72) Inventors: Hak Soo Kim, Seoul (KR); Dong Sub Song, Ansan-si (KR); Jung Beom Koo, Ansan-si (KR)

(73) Assignees: HYUNDAI MOTOR COMPANY, Seoul (KR); KIA CORPORATION, Seoul (KR); MYUNG HWA IND. CO., LTD., Ansan-si (KR)

( * ) Notice: Subject to any disclaimer, the term of this patent is extended or adjusted under 35 U.S.C. 154(b) by 0 days.

(21) Appl. No.: 18/509,959

(22) Filed: Nov. 15, 2023

(65) Prior Publication Data

US 2024/0093684 A1 Mar. 21, 2024

Related U.S. Application Data

(62) Division of application No. 17/884,646, filed on Aug. 10, 2022, now Pat. No. 11,852,139.

(30) Foreign Application Priority Data

Aug. 13, 2021 (KR) ..... 10-2021-0107521

(51) Int. Cl.

| | |
|---|---|
| ***F04C 2/08*** | (2006.01) |
| ***B22F 1/00*** | (2022.01) |
| ***B22F 3/16*** | (2006.01) |

(52) U.S. Cl.
CPC ..... *F04C 2/082* (2013.01); *B22F 1/09* (2022.01); *B22F 3/16* (2013.01);
(Continued)

(58) Field of Classification Search
CPC .. B22F 1/09; B22F 2201/013; B22F 2201/02; B22F 2207/17; B22F 2301/10;
(Continued)

(56) References Cited

U.S. PATENT DOCUMENTS

| | | | |
|---|---|---|---|
| 8,038,761 B2 | 10/2011 | Tanino et al. | |
| 10,710,155 B2 | 7/2020 | Takashita et al. | |

(Continued)

FOREIGN PATENT DOCUMENTS

| | | | |
|---|---|---|---|
| CN | 103753156 A | 4/2014 | |
| CN | 110257717 A * | 9/2019 | ..... C21C 5/52 |

(Continued)

OTHER PUBLICATIONS

CN-110257717-A (Year: 2019).*
Notice of Allowance cited in corresponding Korean application No. 10-2021-0107521; Jul. 30, 2022; 10 pp.

*Primary Examiner* — Anthony Ayala Delgado
(74) *Attorney, Agent, or Firm* — Lempia Summerfield Katz LLC

(57) ABSTRACT

Disclosed are an outer ring for an oil pump having an increased number and size of open pores in a surface of a molded article and a method for manufacturing the outer ring.

3 Claims, 1 Drawing Sheet

(52) U.S. Cl.
CPC ..... *B22F 2201/013* (2013.01); *B22F 2201/02* (2013.01); *B22F 2301/10* (2013.01); *B22F 2301/35* (2013.01); *F04C 2230/22* (2013.01); *F04C 2240/20* (2013.01)

(58) Field of Classification Search
CPC ..... B22F 2301/35; B22F 2998/10; B22F 2999/00; B22F 3/02; B22F 3/1007; B22F 3/16; B22F 5/106; C22C 1/0425; C22C 33/0264; C22C 38/04; C22C 38/20; C22C 38/22; C22C 38/60; F04C 2/082; F04C 2/344; F04C 2230/22; F04C 2240/20
See application file for complete search history.

(56) References Cited

U.S. PATENT DOCUMENTS

| | | | |
|---|---|---|---|
| 2006/0099079 | A1 | 5/2006 | Kawase et al. |
| 2007/0081913 | A1 | 4/2007 | Kawase et al. |
| 2008/0233421 | A1 | 9/2008 | Tanino et al. |
| 2015/0352638 | A1 | 12/2015 | Steiner et al. |
| 2016/0136928 | A1 | 5/2016 | Zhao et al. |
| 2018/0193908 | A1 | 7/2018 | Takashita et al. |
| 2020/0331068 | A1* | 10/2020 | Omori ..... C23C 8/02 |

FOREIGN PATENT DOCUMENTS

| | | | |
|---|---|---|---|
| JP | H07138613 | A | 5/1995 |
| JP | 2008231538 | A | 10/2008 |
| JP | 2019070194 | A | 5/2019 |
| JP | 2019085634 | A | 6/2019 |
| KR | 20050088353 | A | 9/2005 |
| KR | 20060023117 | A | 3/2006 |
| KR | 20180031750 | A | 3/2018 |
| KR | 20200052823 | A | 5/2020 |
| KR | 20200064713 | A | 6/2020 |

* cited by examiner

OUTER RING FOR AN OIL PUMP AND A METHOD FOR MANUFACTURING THE SAME

CROSS-REFERENCE TO RELATED APPLICATION

This application is a divisional application of non-provisional U.S. patent application Ser. No. 17/884,646, filed on Aug. 10, 2022, which claims the benefit of and priority to Korean Patent Application No. 10-2021-0107521, filed on Aug. 13, 2021, the entire contents of which are incorporated herein by reference.

BACKGROUND

(a) Technical Field

The present disclosure relates to an outer ring for an oil pump having an increased number and size of open pores in the surface of a molded article and a method for manufacturing the same.

(b) Background Art

Most outer rings for variable oil pumps are formed of sintered materials, and materials such as FD0405 or FL5305 are used. In order to realize complicated asymmetric shapes, sintering is advantageous compared to forging and cast iron-based methods, and has the advantage of reduced processing costs.

Unlike other oil pump types, variable oil pumps require sufficient surface-hardening of the outer ring due to the direct friction between a vane and the inner surface of the outer ring.

Sintered materials have pores therein and thus can trap oil on the surface thereof, but are relatively advantageous for forming an oil film under harsh situations in consideration of all the worst environmental conditions, as compared to steel or cast iron materials. However, conventional outer rings have high hardness, but cause a phenomenon in which a large number of pores in the surface are filled after the inner surface processing.

Some of the closed pores in the surface may be opened due to fine abrasion of the vane during an oil pump operation, but for abrasion resistance, it is necessary to increase coarse pores without reducing hardness.

Meanwhile, the first technology associated with the material for the outer ring was application of ion nitride to FD0405 (4Ni-1.5Cu-0.5Mo-0.7C), and the next was application of FL5305 (3Cr-0.5Mo-0.5C) material having improved durability. This material uses a pre-alloy powder, and thus has a large number of fine pores therein, but has a problem in which the pores are filled during processing. During operation, closed pores are opened by fine abrasion, but the number of such pores is small and oil film formation is insufficient under harsh test conditions, resulting in abrasion.

A void between iron powder particles formed during pressing after filling a die with a powder is defined as a "pore". A void larger than a pore is defined as a "coarse pore". In this case, as the density is decreased through a variety of methods to increase the number of pores, the size of the pore increases, but as the density decreases, the modulus of elasticity and the surface macro-hardness also decrease. In other words, at the same density, a relatively small number of large-sized pores may be more advantageous in terms of abrasion resistance than a large number of small-sized pores. Coarse pores are less likely than regular-sized pores to close during inner-diameter machining of the outer ring, and are more likely to be opened due to fine abrasion during pump operation.

The above information disclosed in this Background section is only for enhancement of understanding of the background of the present disclosure, and therefore it may contain information that does not form the prior art that is already known to a person of ordinary skill in the art.

SUMMARY OF THE DISCLOSURE

The present disclosure provides a method for manufacturing an outer ring having a high surface macro-hardness while maintaining a density of 6.80 g/cc or more and having many coarse pores in the surface thereof.

The objects of the present disclosure are not limited to those described above. Other objects of the present disclosure will be clearly understood from the following description, and are able to be implemented by means defined in the claims and combinations thereof.

In one embodiment of the present disclosure, a method for manufacturing an outer ring for an oil pump comprises: mixing a pre-alloy powder with a copper mixture to prepare a mixed powder, compacting the mixed powder into a compact, sintering the compact to prepare a sintered body, and sinter hardening the sintered body. In particular, the pre-alloy powder contains 1.35 percent by weight (wt. %) to 1.65 wt. % of chromium, 0.16 wt. % to 0.24 wt. % of molybdenum, 0.10 wt. % to 0.25 wt. % of manganese, and the balance of iron. And the copper mixture contains 15 wt. % to 18 wt. % of carbon, 8 wt. % to 9 wt. % of manganese sulfide, 55 wt. % to 57 wt. % of copper and 19 wt. % to 20 wt. % of a lubricant.

The copper mixture may be mixed in an amount in a range of 3 part to 5 parts by weight based on 100 parts by weight of the pre-alloy powder.

The compact may be compacted to a density of 6.8 g/cc or more.

The sintering may be carried out at a temperature in a range of 1,110° C. to 1,150° C. for 15 to 40 minutes.

The sintering may be carried out in a gas atmosphere containing nitrogen and hydrogen.

The copper may have a particle size in a range of 300 mesh to 350 mesh.

In another embodiment, the present disclosure provides an outer ring manufactured by the method descried above, wherein the outer ring contains iron (Fe), chromium (Cr), molybdenum (Mo), manganese (Mn), sulfur (S), carbon (C) and copper (Cu).

The outer ring contains in a range of 1.30 wt. % to 1.60 wt. % of chromium, 0.16 wt. % to 0.23 wt % of molybdenum, 0.30 wt. % to 0.50 wt % of manganese, 0.10 wt. % to 0.20 wt % of sulfur, 0.51 wt. % to 0.70 wt % of carbon, 1.81 wt. % to 2.22 wt % of copper, and the balance of iron.

Pores having a size of 100 μm or more may be present in 10% or more of the surface of the outer ring.

The outer ring may have a HV0.3 micro-hardness of 550 or more and a HV10 macro-hardness of 280 or more.

Other aspects and embodiments of the present disclosure are discussed infra.

BRIEF DESCRIPTION OF THE DRAWINGS

The above and other features of the present disclosure are now be described in detail with reference to certain embodiments thereof, illustrated in the accompanying drawings which are given hereinbelow by way of illustration only, and thus are not limitative of the present disclosure, and wherein.

DETAILED DESCRIPTION

Figure 1:
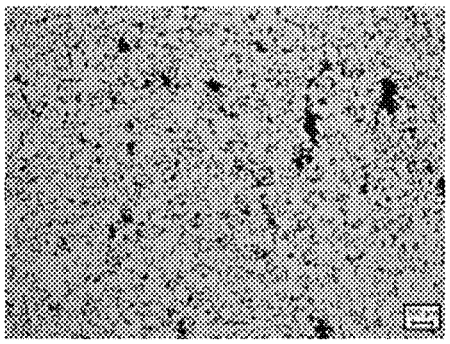
FIG. 1 illustrates a morphology of a surface of a product prepared in Example 1.

The objects described above, as well as other objects, features and advantages, should be clearly understood from the following embodiments with reference to the attached drawings. However, the present disclosure is not limited to the embodiments, and may be embodied in different forms. The embodiments are suggested only to offer a thorough and complete understanding of the disclosed context and to sufficiently inform those having ordinary skill in the art of the technical concept of the present disclosure.

Like reference numbers refer to like elements throughout the description of the figures. In the drawings, the sizes of structures may be exaggerated for clarity. It should be understood that, although the terms "first", "second", etc. may be used herein to describe various elements, these elements should not be construed as being limited by these terms, which are used only to distinguish one element from another. For example, within the scope defined by the present disclosure, a "first" element may be referred to as a "second" element, and similarly, a "second" element may be referred to as a "first" element. Singular forms are intended to include plural forms as well, unless the context clearly indicates otherwise.

It should be further understood that the term such as "comprises" or "has", when used in this specification, specifies the presence of stated features, integers, steps, operations, elements, components or combinations thereof, but does not preclude the presence or addition of one or more other features, integers, steps, operations, elements, components, or combinations thereof. In addition, it should be understood that, when an element such as a layer, film, region, or substrate is referred to as being "on" another element, it can be directly on the other element, or an intervening element may also be present. It should also be understood that when an element such as a layer, film, region, or substrate is referred to as being "under" another element, it can be directly under the other element, or an intervening element may also be present.

Unless the context clearly indicates otherwise, all numbers, figures, and/or expressions that represent ingredients, reaction conditions, polymer compositions and amounts of mixtures used in the specification are approximations that reflect various uncertainties of measurement occurring inherently in obtaining these figures, among other things. For this reason, it should be understood that, in all cases, the term "about" should be understood to modify all numbers, figures and/or expressions. In addition, when numerical ranges are disclosed in the description, these ranges are continuous, and include all numbers from the minimum to the maximum, including the maximum within each range, unless otherwise defined. Furthermore, when the range refers to an integer, it includes all integers from the minimum to the maximum, including the maximum within the range, unless otherwise defined.

It should be understood that, in the specification, when a range is referred to regarding a parameter, the parameter encompasses all figures including end points disclosed within the range. For example, the range of "5 to 10" includes figures of 5, 6, 7, 8, 9, and 10, as well as arbitrary sub-ranges, such as ranges of 6 to 10, 7 to 10, 6 to 9, and 7 to 9, and any figures, such as 5.5, 6.5, 7.5, 5.5 to 8.5, and 6.5 to 9, between appropriate integers that fall within the range. In addition, for example, the range of "10% to 30%" encompasses all integers that include numbers such as 10%, 11%, 12%, and 13%, as well as 30%, and any sub-ranges, such as 10% to 15%, 12% to 18%, or 20% to 30%, as well as any numbers, such as 10.5%, 15.5%, and 25.5%, between appropriate integers that fall within the range.

The present disclosure relates to a method for manufacturing an outer ring for an oil pump having an increased number and size of open pores in the surface of a molded article, and an outer ring manufactured by the method.

Method of Manufacturing Outer Ring

The method for manufacturing an outer ring for an oil pump according to the present disclosure includes mixing a pre-alloy powder with a copper mixture to prepare a mixture, compacting the mixed powder into a compact, and sintering the compact.

Mixed Powder Preparation

In this step, the pre-alloy powder is mixed with the copper mixture to prepare a mixture.

The pre-alloy powder may contain iron (Fe), chromium (Cr), molybdenum (Mo), and manganese (Mn).

In one embodiment, the pre-alloy powder contains in a range of 1.35 wt. % to 1.65 wt. % of chromium, 0.16 wt. % to 0.24 wt. % of molybdenum, 0.10 wt. % to 0.25 wt. % of manganese, and the balance of iron.

In one embodiment, the copper mixture is mixed in an amount in a range of 3 parts to 5 parts by weight based on 100 parts by weight of the pre-alloy powder. At this time, when the content of the copper mixture is less than 3 parts by weight, the hardness of the product may not reach the desired value, and the size of the coarse pores may be lowered, and when the content is higher than 5 parts by weight, processing efficiency may be reduced.

In another embodiment, the copper mixture contains carbon (C), manganese sulfide (MnS), copper (Cu), and a lubricant. Here, addition of the copper powder enables the structure of the material to be strengthened and coarse pores to be obtained.

The lubricant is not particularly limited, but amide wax is used in the present disclosure.

In one embodiment, the copper mixture contains in a range of 15 wt. % to 18 wt. % of carbon, 8 wt. % to 9 wt. % of manganese sulfide, 55 wt. % to 57 wt. % of copper, and 19 wt. % to 20 wt. % of a lubricant. At this time, when the content of copper is less than 55 wt. %, the hardness of the surface of the compact may be lowered. When the content is higher than 57 wt. %, the dimensional change before and after sintering may be excessively increased.

The copper has a particle size in a range of 300 mesh to 350 mesh, in one embodiment, 320 mesh to 330 mesh. In this case, when the copper particle size is less than 300 mesh, the magnitude of dimensional change before and after sintering may be large. When the copper particle size is higher than 350 mesh, there is a risk of the size of the coarse pores being reduced.

Compacting

In this step, the mixed powder is molded into a compact.

The compact is obtained by compacting the mixture to a density of 6.8 g/cc or more.

Sintering

In this step, the compact is sintered to prepare a sintered body. Specifically, the compact is sintered at a temperature in a range of 1,110° C., to 1,150° C. for 15 minutes to 40 minutes. Due to the sintering, the lubricant is finally thermally decomposed and removed.

The sintering may be carried out in a gas atmosphere containing nitrogen and hydrogen, and in one embodiment, the ratio of nitrogen to hydrogen is in a range of 8:2 to 9:1.

Sinter Hardening

In this step, the sintered body is cooled and hardened.

The cooling may be carried out using a fan, at a cooling rate in a range of 2° C./s to 3° C./s.

The method may further include, after cooling, tempering the sintered body at a relatively low temperature, and the tempering may be performed at a temperature in a range of 180° C., to 220° C. for 1 hour to 2 hours.

Outer Ring

The outer ring manufactured by the method for manufacturing an outer ring for an oil pump according to the present disclosure contains iron (Fe), chromium (Cr), molybdenum (Mo), manganese (Mn), sulfur (S), carbon (C), and copper (Cu).

The outer ring more contains 1.30 wt. % to 1.60 wt. % of chromium, 0.16 wt. % to 0.23 wt. % of molybdenum, 0.30 wt. % to 0.50 wt. % of manganese, 0.10 wt. % to 0.20 wt. % of sulfur, 0.51 wt. % to 0.70 wt. % of carbon, 1.81 wt. % to 2.22 wt. % of copper, and the balance of iron. Here, the chromium and molybdenum are matrix-reinforcing elements. When the chromium is present in an amount less than 1.30 wt. %, the strength may be reduced, or 5% or more of bainite may be formed. When the chromium is present in an amount higher than 1.60 wt. %, the dimensional change may increase. In addition, when molybdenum, which is a matrix-reinforcing element, is present in an amount less than 0.16 wt. %, the strength decreases and the stability of the martensite structure is lowered, thereby increasing brittleness. In addition, when the manganese is present in an amount less than 0.30 wt. %, workability may be reduced, and when the manganese is present in an amount greater than 0.50 wt. %, the compacting pressure may be increased and strength may be reduced. In addition, when the sulfur is present in an amount less than 0.10 wt. %, workability may be reduced, and when the sulfur is present in an amount of 0.20 wt. %, an increase in compacting pressure and a decrease in strength may occur. In addition, when the carbon, which is a matrix-reinforcing element, is present in an amount less than 0.51 wt. %, 5% or more of bainite is formed, thereby decreasing strength, and when the carbon is present in an amount greater than 0.70 wt. %, residual austenite may be formed, and micro-hardness may be reduced.

The copper serves to reinforce the matrix, pores are created at the positions where copper powder particles are present by diffusion during sintering, and when the copper is present in an amount less than 1.81 wt. %, the number of opened pores may decrease. When the copper is present in an amount greater than 2.22 wt. %, the matrix may be strengthened, but the dimensional change after sintering may increase.

In one embodiment, pores having a size of 100 μm or more are formed in 10% or more of the surface of the outer ring, and the molded product has a HV0.3 micro-hardness of 550 or more and a HV10 macro-hardness of 280 or more.

Hereinafter, the present disclosure is described in more detail with reference to specific examples. However, the following examples are provided only for better understanding of the present disclosure, and thus should not be construed as limiting the scope of the present disclosure.

EXAMPLE

A pre-alloy powder containing iron, chromium, molybdenum, and manganese was mixed with a copper mixture containing carbon, manganese sulfide, copper, and a lubricant, and then a die was filled with the mixture and punched to produce a compact. Then, the compact was sintered at 1,120° C., for 20 minutes in a gas atmosphere containing nitrogen and hydrogen (nitrogen:hydrogen=6:1) and then sufficiently cooled using a fan to produce a product having the composition shown in Table 1 below (However, the balance of iron (Fe) is omitted, and the particle size of the copper powder that was added when mixing the raw materials is shown in Table 1. Also, the article was molded in the form of a general outer ring for an oil pump.)

TABLE 1

| | Composition | Copper particle size |
|---|---|---|
| Example 1 | 1.5Cr-0.2Mo-0.37Mn-0.12S-0.6C-2.0Cu | 325 mesh |
| Example 2 | 1.5Cr-0.2Mo-0.36Mn-0.11S-0.6C-1.9Cu | 325 mesh |
| Example 3 | 1.5Cr-0.2Mo-0.39Mn-0.13S-0.6C-2.2Cu | 325 mesh |

FIG. 1 illustrates the result of observation of the surface of the product prepared in Example 1. It can be seen from FIG. 1 that a large number of pores having a size of 100 μm or more are observed.

Comparative Example

A product having the composition shown in Table 2 below was prepared in the same manner as in Example described above.

TABLE 2

| | Composition | Copper particle size |
|---|---|---|
| Comparative Example 1 | 1.5Cr-0.2Mo-0.38Mn-0.12S-0.6C-2.0Cu | 325 Mesh |
| Comparative Example 2 | 1.5Cr-0.2Mo-0.38Mn-0.13S-0.6C | 325 Mesh |
| Comparative Example 3 | 1.5Cr-0.2Mo-0.37Mn-0.12S-0.6C-3.0Cu | 325 Mesh |
| Comparative Example 4 | 1.5Cr-0.2Mo-0.36Mn-0.13S-0.6C-2.0Cu | 200 Mesh |
| Comparative Example 5 | 1.5Cr-0.2Mo-0.37Mn-0.12S-0.6C-2.0Cu | 400 Mesh |

Figure 2:
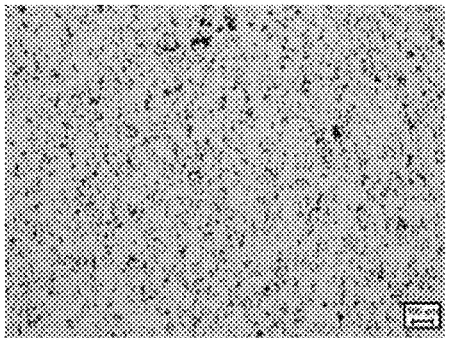
FIG. 2 illustrates a morphology of a surface of a product prepared in Comparative Example 1.

FIG. 2 illustrates the result of observation of the surface of the product prepared in Comparative Example 1. It can be seen from FIG. 2 that a large number of small-sized pores are observed.

Experimental Example 1

The sintering density, hardness, yield strength, tensile strength, and dimensional change of the product according to Examples 1 to 3 and Comparative Examples 1 to 5 were measured, and are shown in Table 3 below.

TABLE 3

| | Density | Micro-hardness (Hv 0.3) | Macro-hardness (Hv 10) | Yield strength (MPa) | Tensile strength (MPa) | Inner-diameter dimensional change (%) |
|---|---|---|---|---|---|---|
| Example 1 | 6.87 | 634 | 335 | 649 | 852 | 1.0002 |
| Example 2 | 6.87 | 634 | 335 | 649 | 852 | 1.0002 |
| Example 3 | 6.87 | 634 | 335 | 649 | 852 | 1.0002 |
| Comparative Example 1 | 6.87 | 634 | 335 | 649 | 852 | 1.0002 |
| Comparative Example 2 | 6.91 | 529 | 274 | 586 | 792 | 0.9990 |
| Comparative Example 3 | 6.93 | 665 | 358 | 689 | 899 | 1.0011 |
| Comparative Example 4 | 6.86 | 629 | 321 | 629 | 839 | 1.0005 |
| Comparative Example 5 | 6.89 | 658 | 342 | 660 | 861 | 1.0002 |

As is apparent from the foregoing, the present disclosure provides a method for manufacturing an outer ring having a high surface macro-hardness while maintaining a density of 6.80 g/cc or more and having many coarse pores in the surface thereof.

The effects of the present disclosure are not limited to those mentioned above. It should be understood that the effects of the present disclosure include all effects that can be inferred from the description of the present disclosure.

The present disclosure has been described in detail with reference to some embodiments thereof. However, it will be appreciated by those having ordinary skill in the art that changes may be made in these embodiments without departing from the principles and spirit of the present disclosure.

What is claimed is:

1. An outer ring for an oil pump, the outer ring comprising: 1.30 wt. % to 1.60 wt. % of chromium, 0.16 wt. % to 0.23 wt. % of molybdenum, 0.30 wt. % to 0.50 wt. % of manganese, 0.10 wt. % to 0.20 wt. % of sulfur, 0.51 wt. % to 0.70 wt. % of carbon, 1.81 wt. % to 2.22 wt. % of copper, and a balance of the iron.

2. The outer ring according to claim 1, wherein pores having a size of 100 μm or more are present in 10% or more of a surface of the outer ring.

3. The outer ring according to claim 1, wherein the outer ring has a HV0.3 micro-hardness of 550 or more and a HV10 macro-hardness of 280 or more.

* * * * *